United States Patent [19]

Hirschel et al.

[11] 4,199,018

[45] Apr. 22, 1980

[54] FOLDING PARTITION SHIFTABLY SUSPENDED FROM A CEILING

[76] Inventors: Adolf Hirschel, Schonbergerweg 17; Horst Böhm, Unter den Eschen 9, both of 6 Frankfurt am Main, Fed. Rep. of Germany

[21] Appl. No.: 852,021

[22] Filed: Jan. 26, 1978

[51] Int. Cl.[2] ..... A47H 5/00

[52] U.S. Cl. ..... 160/84 R

[58] Field of Search ..... 160/84 R, 84 M, 84 V, 160/33

[56] References Cited

U.S. PATENT DOCUMENTS

| | | | |
|---|---|---|---|
| 958,961 | 5/1910 | Hedwall | 160/33 |
| 3,029,867 | 4/1962 | Maurer | 160/84 R |

FOREIGN PATENT DOCUMENTS

| | | | |
|---|---|---|---|
| 2602633 | 7/1977 | Fed. Rep. of Germany | 160/84 R |

*Primary Examiner*—Peter M. Caun

*Attorney, Agent, or Firm*—McGlew and Tuttle

[57] ABSTRACT

A folding partition comprising a plurality of folding panels hinged to each other and slidably suspended from a ceiling. A control plate is fixed adjacent the hinged folding panels and includes a plurality of first and second stops which extend therefrom. Every other folding panel includes a control member extending therefrom with each control member engageable with one of the first stops as the folding partition is folded to cause two adjacent folding panels to pivot about their connecting hinges. Each control member is abuttable against each second stop as the folding partition is opened to pivot adjacent said folding panels in an opposite direction. Each control member is connected to each associated folding panel at a different vertical location and each first and second stop associated with each control member is located at a different horizontal location on the control plate corresponding to the horizontal positions of their associated control members. Each of the first and second stops are also offset from each other in a horizontal direction corresponding to the width of the folding partition as it is folded.

8 Claims, 3 Drawing Figures

10
12
14
16
18
20
26
28
30
32
34
36
38
40
42
44
46
48
50

FOLDING PARTITION SHIFTABLY SUSPENDED FROM A CEILING

The invention relates to a folding partition shiftably suspended from a ceiling and made up of folding sections which are hinged to each other for folding and unfolding, with a space being provided for receiving the folded sections upon retracting the partition and with a control mechanism for actuating the folding sections.

Known designs of such folding partitions in which the individual folding sections are coupled to each other, for example, by means of lazy tongs have the disadvantage that all of the folding sections are actuated simultaneously, so that with large folding partitions, a considerable force is needed and the stretched position is obtained only with the partition fully extended.

Other designs known up to the present time, in which the folding sections are actuated individually one after the other have the disadvantage that while retracting the folding partition, the foremost section folds first while the sections at the wall side may still remain stretched.

In another design, a folding gate disclosed in German Pat. No. 534 356, a control mechanism consisting of levers is provided by means of which, for opening the gate, the individual parts of the gate wall are folded sequentially. This control mechanism, however, has no effect on the unfolding of the individual parts of the gate wall. The unfolding is incidental and depends on the frictional conditions between the respective folding sections or wall parts of the folding gate.

SUMMARY OF THE PRESENT INVENTION

The invention is directed to a smoothly extensible folding partition in which the individual folding sections are positively controlled for consecutive unfolding while extending the partition, and during the retraction of the partition, the rearmost section, i.e. the section adjacent the wall, is folded first.

This makes it possible to accommodate the pack of the folded partition in a niche wherefrom the partition may be smoothly drawn out and into which it may be slipped in even configuration, irrespective of its initial position.

To this end, in a folding partition or door of the above mentioned kind and in accordance with the invention, it is provided that the control mechanism comprises fixed stops, which are associated with each of the folding sections and disposed on a common carrier, and control members, which are provided on one of the folding plates of each folding section and cooperate with the stops. The fixed control members are offset in the direction of motion of the folding partition in accordance with the thickness of the folded folding sections, and the stops and the control members associated therewith of each of the folding sections are provided at different levels, in spaced relationship to each other.

Accordingly, an object of the present invention is to provide a folding partition slidably suspended from a ceiling comprising, a plurality of folding sections which are hinged to each other for folding and unfolding, each folding section comprising a pair of panels hinged to each other, a space provided for receiving the folding sections upon retracting the partition, a control mechanism for actuating the folding section, the control mechanism comprising a control plate, a plurality of fixed stop sets each comprising a first and second stop, with each stop set associated with each of said folding section and disposed on said control plate, a control member connected to one of the panels of each of said folding sections, and cooperating with a respective stop set with each stop set offset in the direction of motion of the folding partition corresponding to a thickness of each folding section when it has been folded, each stop set and each associated control member being offset in a vertical direction.

Another object of the present invention is to provide a folding partition which is simple in design, rugged in construction and economical to manufacture.

For an understanding of the principles of the invention, reference is made to the following description of typical embodiments thereof as illustrated in the accompanying drawings.

DESCRIPTION OF THE PREFERRED EMBODIMENTS

Figure 1:
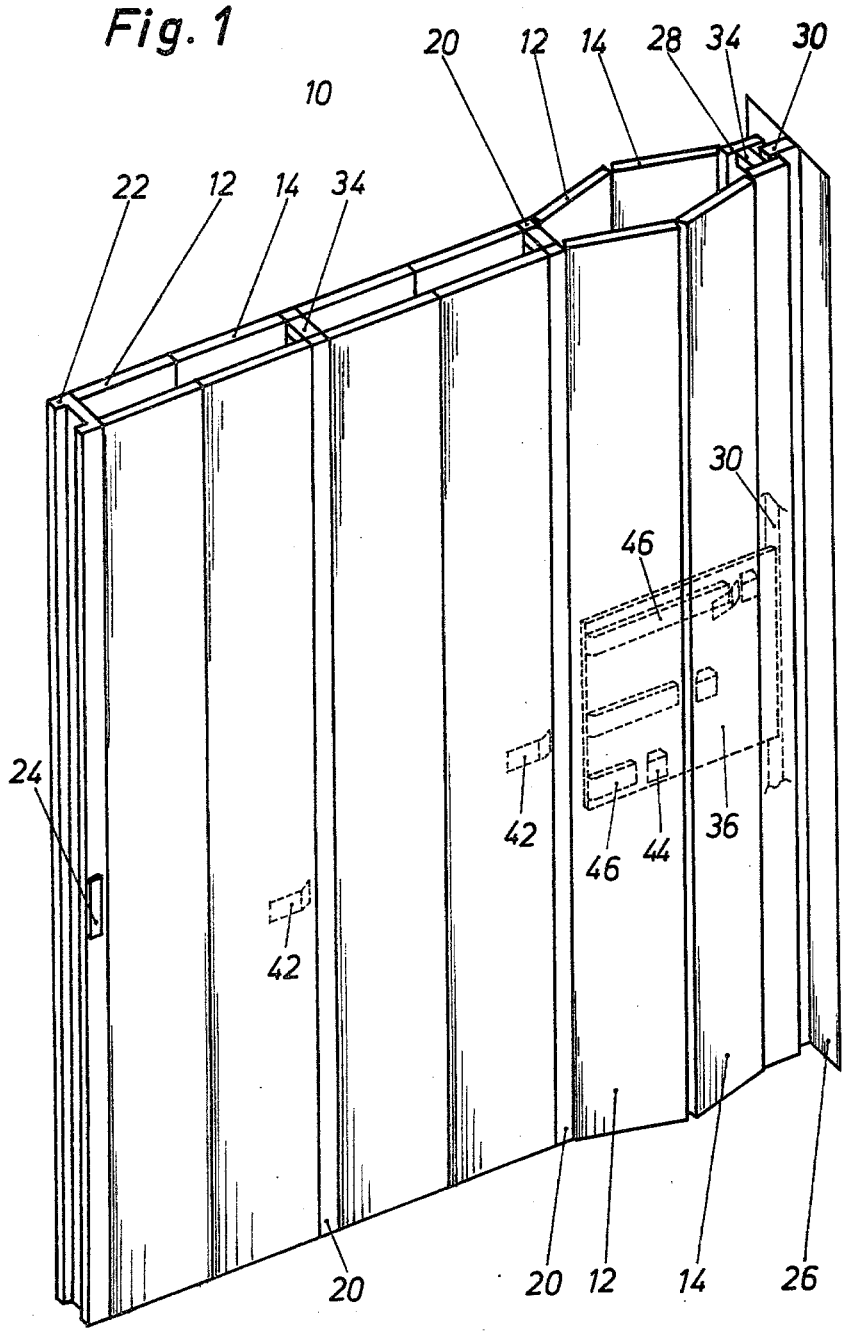
FIG. 1 is a simplified prespective view of a partition or door in accordance with the invention.
Figures 2, 3:
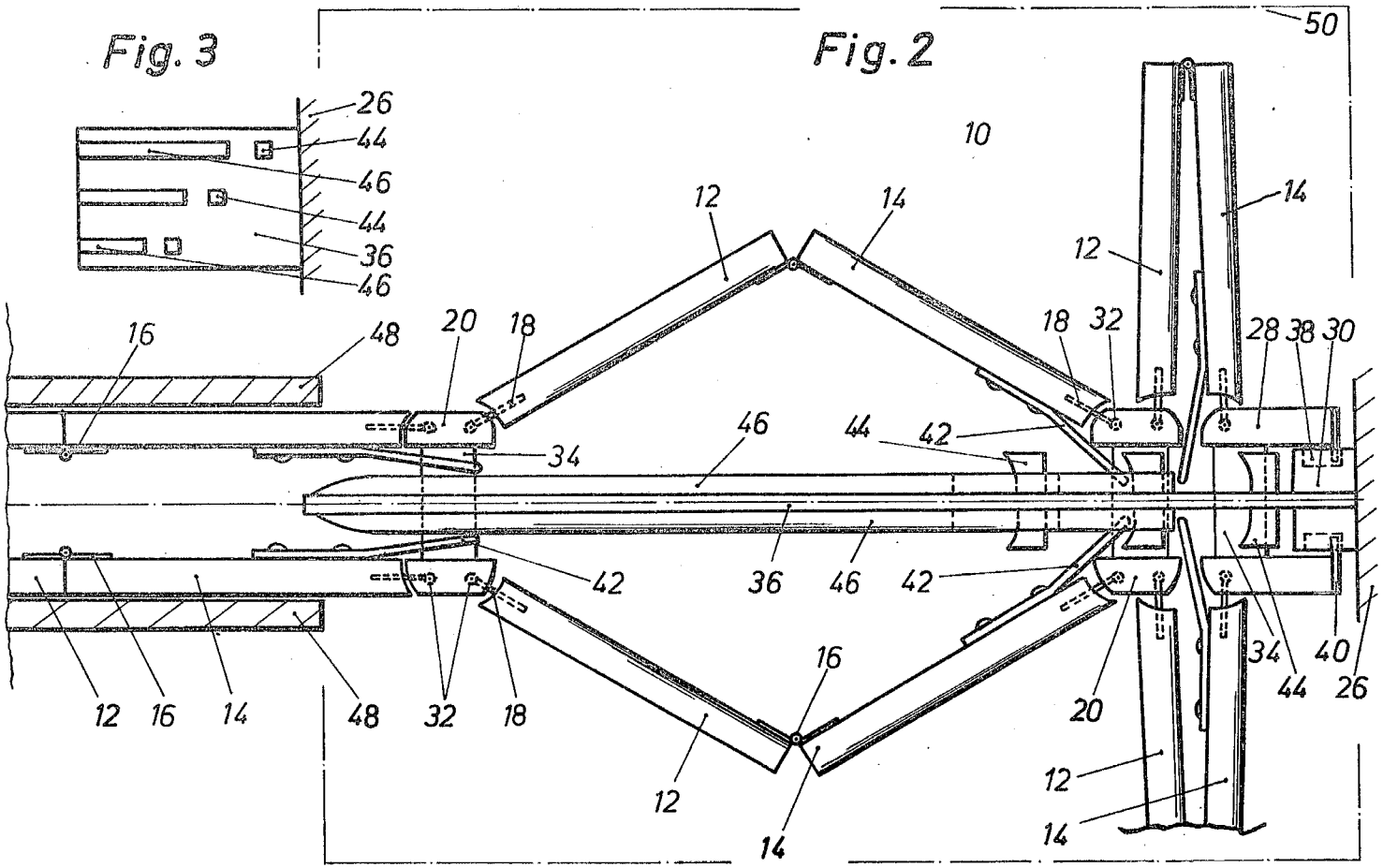
FIG. 2 is a top plan view of the partition or door shown in FIG. 1.
FIG. 3 is a side elevational view, on a reduced scale, of the control plate shown in FIG. 2.

Referring to the figures, the folding partition or door 10 comprises a number of pairs 12, 14 of folding partition sections or panels. follows particularly from FIG. 1. These folding partition section pairs 12, 14 are jointed to each other by means of hinges 16 as shown in FIG. 2. The other long edge faces of folding section 12, 14 are connected to connecting strips or members 20 through connecting members 18. The free end of the folding partition or door terminates with an end strip or members 22 which also carries a handle 24 for actuating the partition or door 10.

The folding partition 10 is anchored to a firm wall 26 through end strips or members 28 which are secured to the wall 26 by means of retaining strips or members 30. The folding sections 12, 14 are connected to the connecting strips 20 through the connecting members 28 which are pivoted thereto at 32. The connecting strips 20 are firmly connected to each other by means of connecting or bridging parts 34.

The connecting parts 34 are shiftably or slidably suspended from the ceiling. To simplify the drawing, this suspension and roller guide mechanism known per se is not indicated.

As may be seen particularly in FIG. 2, within a receiving space 50 near wall 26 for the folded folding sections 12, 14, indicated in dash-dotted lines, a control plate 36 is provided at wall 26, which extends between the opposite and folded folding sections 12, 14.

As shown in FIG. 2, end strips 28 are retained by means of slide pieces 40 secured to end strip 28 which project into recesses 38 of retaining strips 30 and allow a limited displacement within recesses 38 of end strips 28 relative to retaining strips 30.

Each folding section 14 of each following section pair 12, 14 carries a control member 42 which, during the retraction of the extended folding partition 10, butts against one of the first stops 44 provided on control plate 36. This produces a moment of force about hinge point 32 whereby the folding process for the corresponding folding section pair 12, 14 is started.

Each control member 42 of a folding section pair 12, 14 is associated with a specific stop 44.

Control plate 36 further carries second stops 46 of longer extension which, as shown more particularly in the figures, cooperate with control members 42, arrest each of the folding section pairs 12, 14 in its position, and permit an unfolding of these pairs only after during the closing of the folding partition or door 10 the preceding folding section pair 12, 14 has already been stretched to its substantially aligned position. Along the suspension structure at the ceiling (not shown) supporting the partition 10, lateral guide bars 48 in the form of facing boards are provided. With the extended, stretched partition 10, they prevent the folding section pairs 12, 14 from folding incidentally. Guide bars 48 extend approximately only to the end of the receiving space 50 indicated in dash-dotted lines, the length of which substantially corresponds to the pack thickness of the completely folded partition 10. The unfolding of folding section pairs 12, 14 also takes place in this zone.

In the space 50 for receiving the folded partition sections 12, 14, stops 46 assume the function of guides up to the respective point of release of the folding process, and for this purpose they are made longer than necessary for merely arresting the folding section pairs 12, 14.

As shown in FIG. 2, stops 44 and 46, of which only three are indicated corresponding to the shown folding section pairs 12, 14, are offset relative to each other in the horizontal direction. This setoff corresponds approximately to the thickness of a completely folded folding section pair 12, 14.

As further shown in FIG. 3, the stops 44 and 46 associated with a folding section pair 12, 14 are spaced from each vertically as well.

The offset start of the action stops 44, 46 and the vertical spacing of stops 44, 46 associated with the folding section pairs 12, 14 of partition 10 ensure that the unfolding and folding of folding section pairs 12, 14 is effected positively in sequence.

The invention has been explained with reference to an embodiment comprising a double-walled folding partition or door. It is easily understandable, however, that one part of partition 10 or one of the partition walls may be omitted, so as to obtain a simple, single-wall folding partition. The guide bar 48 acting as a facing board is not abolutely necessary for guiding folding section pairs 12, 14, since the articulate construction may be such that due to a particular position relative to each other of the hinge axes or points 32 of connecting members 18 and the hinge points of hinges 16 of folding section pairs 12, 14, upon squeezing the partition 10 during the extension thereof, folding sections 12, 14 experience a buckling moment directed away from the facing board or guide bar 48. Such an effect is obtained if, as shown in FIG. 1 at the left-hand side, the axis of hinge 16 is offset in the unfolding direction of folding section pairs 12, 14 relative to the plane connecting the hinge points or axes 32.

The invention makes it possible to install folding partitions or doors of single-wall or double-wall design, which can be actuated by applying only a small force and with which, in particular, due to a simple, costs and space saving control stop mechanism easy to manufacture, it is ensured that the folding parts of the partition or door are folded or unfolded for opening or closing in a completely satisfactory manner one after the other, and that the extended portion of the partition or door is always kept in an even, plane configuration, during both closing and opening.

While specific embodiments of the invention have been shown and described in detail to illustrate the application of the principles of the invention, it will be understood that the invention may be embodied otherwise without departing from such principles.

We claim:

1. A shiftably suspended folding partition made of folding sections which are hinged to each other for folding and unfolding, with a space being provided for receiving the folded sections upon retracting the partition and with a control mechanism for actuating the folding sections, characterized in that while closing the partition or door (10), the control mechanism causes the folding sections (12, 14) to straighten out, and while opening the partition door (10), the control mechanism causes the folding sections (12, 14) to fold the control mechanism comprising a cam plate (36) having two control cams (44, 46) for each folding section pair (12, 14), with one of the control cams (46) cooperating with a control lug (42) for holding the folding section pairs (12, 14) unfolded, and one of the control cams (44) cooperating with the control lug (42) for folding the folding section pairs (12, 14), the control lug (42) being provided on each of the folding section parts (14) at the side of the receiving space (50), the control cams (44,46) and thecontrol lugs (42) of each of folding section pairs (12, 14) being offset vertically relative to each other, in a manner such that each folding section (12, 14) is associated with control cams (44, 46) of its own which are offset relative to each other in the horizontal direction, so as to positively cause a sequential unfolding or folding of the folding section pairs (12, 14) upon actuating the partition or door (10).

2. A partition according to claim 1, wherein upon actuating the partition for closing, one of the cams (46) of cam plate (36) holds the associated folding section pair (12, 14) locked in the folded position thereof, until shortly before the unfolding of the preceding folding section pair (12, 14) is completed.

3. A partition according to claim 1, wherein in the zone where the partition or door (10) is straightened out, the suspension at the ceiling is covered by facing boards (48) functioning as guides for the folding sections (12, 14).

4. A partition according to claim 1, wherein the free ends of adjacent folding section pairs (12, 14) are hinged to common connecting strips (20).

5. A partition according to claim 1, wherein the partition (10) is designed with multiple-wall sections.

6. A folding partition slidably suspended from a ceiling comprising, a plurality of folding sections which are hinged to each other for folding and unfolding, each folding section comprising a pair of panels hinged to each other, a control mechanism for actuating the folding section to retract and extend the partition, the control mechanism comprising a control plate, a plurality of fixed stop sets connected to and extending from said control plate, each stop set comprising a first and second stop and each stop set associated with each of said folding sections, a control member connected to one of the panels of each of said folding sections, each control member abutable against a respective first stop of each of said stop sets suitable for respective folding section, and abutable against a second stop of each of said stop sets for unfolding said respective folding section, each of said control members beoing positioned at a different vertical location with each of said stop sets positioned at a different vertical location on said control plate corresponding to that of each of said associated control members, and each of said stop sets offset in a direction of folding of said folding partition corresponding to the folded thickness of each of said folding sections, whereby the folding partition is retracted by folding said folding sections one at a time as their respective control members abut with a respective first stop.

7. A folding partition, according to claim 12, further including a connecting strip hingedly connected between each of said folding sections at hinged points, with a plane containing the hinged points of said connecting strip being offset from a plane containing the hinged connection between each pair of said panels in a direction opposite that taken by said hinged connections between said pairs of panels when said folding partition is being folded.

8. A folding partition according to claim 12, further including at least one guide bar connected adjacent a portion of said folding partition which is extended.

* * * * *